US008989650B2

(12) United States Patent
Yang

(10) Patent No.: US 8,989,650 B2
(45) **Date of Patent: *Mar. 24, 2015**

(54) PRINTING MEDIUM ALIGNMENT DEVICE WITH ROLLERS ATTACHED AND IMAGE FORMING APPARATUS HAVING THE SAME

(71) Applicant: Samsung Electronics Co., Ltd., Suwon-si, Gyeonggi-do (KR)

(72) Inventor: Chun Seung Yang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/915,066

(22) Filed: Jun. 11, 2013

(65) Prior Publication Data

US 2013/0279961 A1 Oct. 24, 2013

Related U.S. Application Data

(63) Continuation of application No. 12/098,682, filed on Apr. 7, 2008, now Pat. No. 8,478,182.

(30) Foreign Application Priority Data

Jun. 15, 2007 (KR) ..... 10-2007-58954
Aug. 2, 2007 (KR) ..... 10-2007-77794

(51) Int. Cl.
*G03G 15/00* (2006.01)
*B65H 9/00* (2006.01)
(Continued)

(52) U.S. Cl.
CPC ..... *G03G 15/6561* (2013.01); *B41J 13/03* (2013.01); *B41J 13/103* (2013.01); *B41J 13/28* (2013.01);
(Continued)

(58) Field of Classification Search
USPC ..... 399/395, 401; 400/579, 630; 271/226, 271/229, 230, 234, 243–245, 253, 254
See application file for complete search history.

(56) References Cited

U.S. PATENT DOCUMENTS 2,069,918 A 2/1937 Gegenheimer
4,019,732 A 4/1977 Hunt et al.
(Continued)

FOREIGN PATENT DOCUMENTS

EP 547857 A2 6/1993
JP 2004-26343 1/2004

OTHER PUBLICATIONS

Office Action dated Jan. 6, 2011 in U.S. Appl. No. 12/098,682.
(Continued)

*Primary Examiner* — Ren Yan
*Assistant Examiner* — Justin Olamit
(74) *Attorney, Agent, or Firm* — Staas & Halsey LLP

(57) ABSTRACT

A printing medium alignment device and an image forming apparatus having the same, the image forming apparatus includes a printing medium supply unit to supply a printing medium, a printing unit to print an image on the printing medium supplied from the printing medium supply unit, and a printing medium alignment device to align the printing medium fed toward the printing unit. The printing medium alignment device includes: a register roller; an idle roller to form a nip with the register roller, to feed the printing medium to the printing unit; a register to move to a first position to block the printing medium from entering the nip, to align the printing medium, and to move to a second position to allow the printing medium to enter the nip; and a shutter roller mounted in the register shutter. When the register shutter is in the second position, the shutter roller rolls while in contact with the printing medium, to decrease a friction between the printing medium and the register shutter.

11 Claims, 5 Drawing Sheets

(51) Int. Cl.

| | |
|---|---|
| ***B65H 9/04*** | (2006.01) |
| ***B41J 13/03*** | (2006.01) |
| ***B41J 13/10*** | (2006.01) |
| ***B41J 13/28*** | (2006.01) |
| ***B65H 9/06*** | (2006.01) |

(52) U.S. Cl.

CPC ..... *B65H 9/004* (2013.01); *B65H 9/06* (2013.01); *G03G 15/6558* (2013.01); *B65H 2801/06* (2013.01); *G03G 2215/00405* (2013.01); *G03G 2215/00565* (2013.01)

USPC ..... 399/395; 271/226; 271/243; 271/245

(56) References Cited

U.S. PATENT DOCUMENTS

| | | | |
|---|---|---|---|
| 5,566,933 | A | 10/1996 | Salancy |
| 5,934,668 | A | 8/1999 | Debarber et al. |
| 6,011,948 | A | 1/2000 | Amano et al. |
| 6,079,887 | A | 6/2000 | Koyabu et al. |
| 6,167,231 | A | 12/2000 | Blackman et al. |
| 6,805,509 | B2 | 10/2004 | Ahn |
| 7,177,587 | B2 | 2/2007 | Sugata |
| 7,789,388 | B2 | 9/2010 | Matsubara et al. |
| 2004/0113352 | A1 | 6/2004 | Chiang |
| 2007/0126176 | A1 | 6/2007 | Ha |

OTHER PUBLICATIONS

Office Action dated Jan. 13, 2013 in U.S. Appl. No. 12/098,682.

Office Action dated May 24, 2011in U.S. Appl. No.12/098,682.

Office Action dated May 1, 2012 in U.S. Appl. No. 12/098,682.

Notice of Allowance dated Mar. 1, 2013 in U.S. Appl. No. 12/098,682.

Office Action dated Sep. 29, 2011 in U.S. Appl. No. 12/098,682.

PRINTING MEDIUM ALIGNMENT DEVICE WITH ROLLERS ATTACHED AND IMAGE FORMING APPARATUS HAVING THE SAME

CROSS-REFERENCE TO RELATED APPLICATIONS

This is a continuation application of U.S. application Ser. No. 12/098,682 filed on Apr. 7, 2008, which claims the benefit of Korean Patent Application Nos. 2007-58954 and 2007-77794, filed on Jun. 15, 2007 and Aug. 2, 2007, respectively, in the Korean Intellectual Property Office, the disclosures of which are incorporated herein by reference.

BACKGROUND OF THE INVENTION

1. Field of the Invention

Aspects of the present invention relates to an image forming apparatus, and more particularly, to a printing medium alignment device and an image forming apparatus having the same, which aligns a front end of a printing medium supplied to a printing unit.

2. Description of the Related Art

An image forming apparatus is an apparatus that prints a black and white image, or a color image, on a printing medium, e.g., paper, according to an image signal. An image forming apparatus can be, for example, a laser printer, an ink-jet printer, a copying machine, a multi-function printer, a fax machine, etc. An image forming apparatus can be classified as an electrophotographic type, in which a beam is scanned to a photosensitive body to form an electrostatic latent image and a developer is supplied to the electrostatic latent image to transfer the same onto a printing medium; or an ink-jet type, in which a liquid ink is ejected onto the surface of a printing medium, according to an image signal.

An image forming apparatus generally includes: a printing medium supply unit, which contains sheets of printing media, and supplies the printing medium sheet by sheet; a printing unit, which prints letters or pictures on the printing medium supplied from the printing medium supply unit; and a printing medium discharge unit, which discharges the printed printing medium. In the electrophotographic image forming apparatus, the printing unit includes: a photosensitive body, on which an electrostatic latent image is formed; an exposure unit that radiates light to the photosensitive body; a developing unit that supplies a developer to the electrostatic latent image formed on the photosensitive body, to form a visible image; a transfer unit that transfers the visible image to the printing medium; and a fusing unit that fuses the visible image to the printing medium, by applying heat and pressure to the printing medium. In the ink-jet image forming apparatus, the printing unit is provided with a print head that ejects an ink onto the surface of the printing medium, according to an image signal.

The both types of image forming apparatuses further include a printing medium alignment device, which is provided upstream from the printing unit (with respect to a paper transfer direction), to uniformly align the front end of the printing medium supplied from the printing medium supply unit. The printing medium supplied from the printing medium supply unit may get twisted/misaligned when it is fed to the printing unit. Such a misalignment may result in reduced printing quality. To prevent this problem, the printing medium alignment device aligns the printing medium, before the printing medium advances to the printing unit.

An example of a conventional printing medium alignment device is disclosed in Japanese Patent Laid-Open Publication No. 2004-26343 (published on Jan. 29, 2004). The disclosed printing medium alignment device includes: a register roller that rotates by receiving a driving force; an idle roller that contacts the register roller, and rotates together with the register roller; and a register shutter that is mounted so as to contact the front end of the printing medium, as the printing medium advances into a nip formed between the register roller and the idle roller. If the front end of the printing medium is properly aligned, the register shutter rotates to pass the printing medium.

The register shutter is provided with plural front-end touch parts, which contact the front end of the printing medium. When an external force, which is larger than a predetermined force, is applied, the register shutter is rotated. If the printing medium gets twisted, and thus, the front end of the printing medium does not contact all of the front-end touch parts, the pushing force is too weak to rotate the register shutter, so the register shutter continues to block the printing medium. If the printing medium is aligned, and thus, the front end of the printing medium contacts all the front-end touch parts, the register shutter rotates, and the printing medium progresses between the register roller and the idle roller.

For the register roller to align the front end of the printing medium, the front-end touch parts should be arranged in parallel, in a direction perpendicular to a feeding direction of the printing medium, and should not be bent nor deformed. In order to prevent wear and bending of the register shutter, the register shutter is typically made of a material mixed with a glass fiber.

However, because the register shutter successively contacts the printing medium, noise occurs when the printing medium pushes the register shutter and progresses. Further, the noise increases when the printing operation is performed at a high speed.

SUMMARY OF THE INVENTION

An aspect of the invention provides a printing medium alignment device and an image forming apparatus having the same, which can decrease noises that occur when a printing medium passes through a printing medium alignment device, and can decrease wear of a register shutter.

Additional aspects and/or advantages of the invention will be set forth in part in the description which follows, and in part, will be obvious from the description, or may be learned by practice of the invention.

In accordance with an aspect of the invention, there is provided an image forming apparatus comprising: a printing medium supply unit to supply a printing medium; a printing unit to print an image on the printing medium supplied from the printing medium supply unit; and a printing medium alignment device. The printing medium alignment device includes: a register roller; an idle roller to form a nip by contacting the register roller, and to feed the printing medium supplied from the printing medium supply unit to the printing unit; a register shutter to temporarily block a front end of the printing medium from proceeding toward the nip, to align the printing medium, and to rotate out of a feeding path of the printing medium, to pass the printing medium; and at least one shutter roller mounted in the register shutter. When the register shutter deviates from the feeding path, the shutter roller rolls while in contact with the printing medium, to decrease friction between the printing medium and the register shutter.

According to aspects of the present invention, the register shutter may include at least one front-end touch part having a front-end touch surface, which contacts the front end of the printing medium. The shutter roller may be mounted to a lower portion of the front-end touch surface.

According to aspects of the present invention, the shutter roller may be mounted such that an outer peripheral surface of the shutter roller, which contacts the printing medium, protrudes from the front-end touch surface.

According to aspects of the present invention, the register shutter may include a plurality of front-end touch parts, and a shutter roller may be mounted on each of the front-end touch parts.

According to aspects of the present invention, the front-end touch part may be coupled with a coupling shaft, to rotatably support the shutter roller.

In accordance with another aspect of the invention, there is provided a printing medium alignment device comprising: a register roller; an idle roller to contact the register roller, to form a nip with the register roller; a register shutter to selectively block a front end of the printing medium from proceeding toward the nip, to align the printing medium, and to rotate out of a feeding path of the printing medium to pass the printing medium; and at least one shutter roller mounted on the register shutter. When the register shutter deviates from the feeding path, the shutter roller rolls while in contact with the printing medium, to decrease friction between the printing medium and the register shutter.

BRIEF DESCRIPTION OF THE DRAWINGS

These and/or other aspects and advantages of the invention will become apparent and more readily appreciated from the following description of the exemplary embodiments, taken in conjunction with the accompanying drawings, of which.

DETAILED DESCRIPTION OF THE EMBODIMENTS

Figure 1:
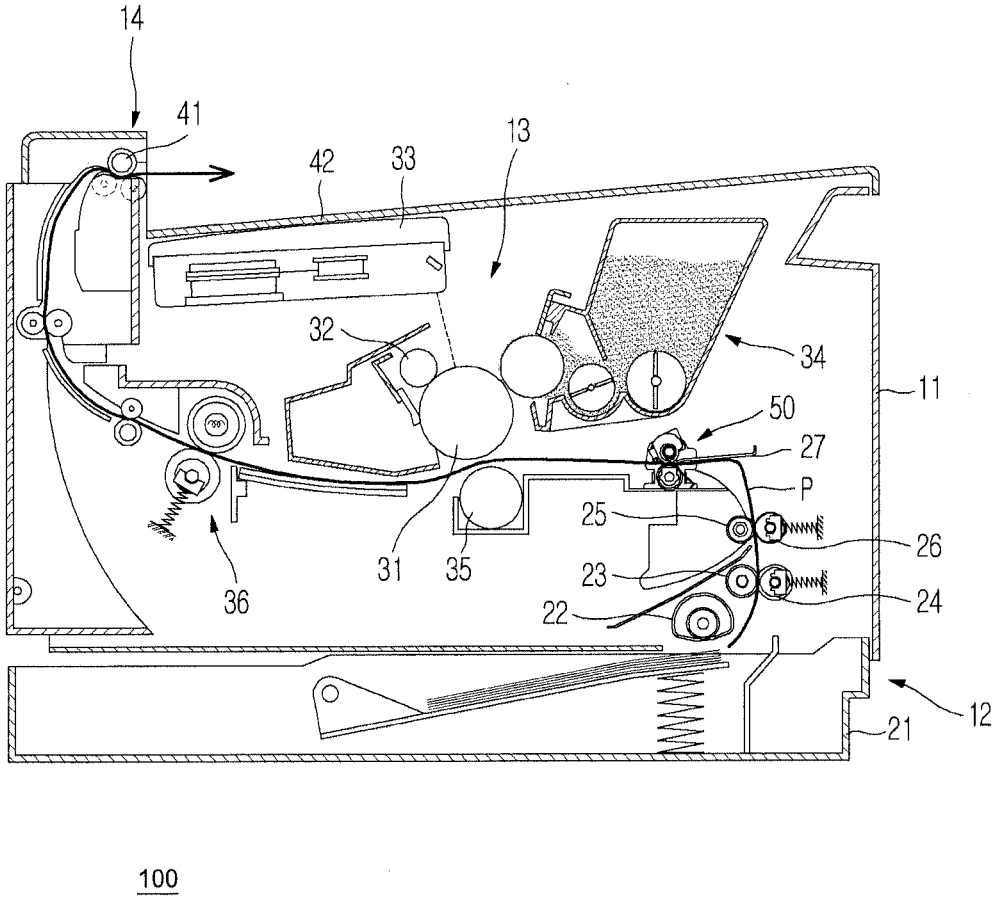
FIG. 1 is a side-sectional view schematically illustrating an image forming apparatus, in accordance with aspects of the present invention.

Reference will now be made in detail to exemplary embodiments of the present invention, examples of which are illustrated in the accompanying drawings, wherein like reference numerals refer to like elements throughout. The exemplary embodiments are described below, in order to explain the aspects of present invention, by referring to the figures.

As shown in FIG. 1, an image forming apparatus 100, according to an exemplary embodiment of the present invention, is an electrophotographic image forming apparatus. The image forming apparatus 100 includes: a main body 11 that forms an external appearance; a printing medium supply unit 12 to supply a printing medium; a printing unit 13 to print an image on the printing medium; a printing medium discharge unit 14 to discharge the printing medium from the main body 11; and a printing medium alignment device 50 to align the printing medium supplied from the printing medium supply unit 12. As referred to herein, the printing medium can be paper, transparency sheets, envelopes, or any suitable printable material.

The printing medium supply unit 12 includes a printing medium loading cassette 21 that contains sheets of printing media, a pickup roller 22 that picks up single sheets of the printing media from the loading cassette 21, and rollers 23, 24, 25, and 26 that are mounted in a feeding path P of the printing medium, to feed the printing medium toward the printing unit 13. The rollers include a first feeding roller 23 mounted near the pickup roller 22, a double-feed prevention roller 24 disposed in contact with the first feeding roller 23, a second feeding roller 25 mounted downstream from the first feeding roller 23, to rotate according to a driving force from a driving source (not shown), and an idle roller 26 to rotate with the first feeding roller 23 and the second feeding roller 25, while contacting the second feeding roller 25. If two or more sheets of printing media are picked up from the printing medium loading cassette 21, the double-feed prevention roller 24 back feeds any of the printing medium that does not contact the first feeding roller 23, to the printing medium loading cassette 21.

The printing unit 13 includes: a photosensitive body 31 where an electrostatic latent image is formed; a charge roller 32 that charges the photosensitive body 31 with a predetermined electric potential; an exposure unit 33 that radiates light to the photosensitive body 31, according to an image signal; a developing unit 34 that supplies a developer to the photosensitive body 31, to form a visible image; a transfer roller 35 that transfers the visible image formed on the photosensitive body 31 onto the printing medium; and a fusing unit 36 that fuses the transferred visible image to the printing medium.

The printing medium discharge unit 14 includes a discharge roller 41 that discharges the printing medium to the exterior of the main body 11, and a discharge tray 42 to receive the printing medium discharged from the main body 11. The printing medium alignment device 50 is mounted between the printing medium supply unit 12 and the printing unit 13. The printing medium alignment device 50 aligns the front end of the printing medium supplied from the printing medium supply unit 12, and then feeds the printing medium to the printing unit 13.

Although they are not illustrated in the drawings, a driving source is mounted inside the main body 11, to generate a driving force used in the operation of the image forming apparatus. A control device (not shown) to control the overall operation of the image forming apparatus 100 may also be included.

If the printing operation of the image forming apparatus 100 is started, the pickup roller 22 picks up the printing medium from the printing medium loading cassette 21, and feeds the printing medium to the printing medium alignment device 50. The light generated from the exposure unit 33 is radiated onto the surface of the photosensitive body 31, which is charged with a predetermined electric potential by the charge roller 32, according to an image signal. An electrostatic latent image is thereby formed on the photosensitive body 31. The developer is applied to the electrostatic latent image by the developing unit 34, to form a visible image. The visible image is transferred onto the surface of the printing medium by the transfer roller 35, and is fused to the printing medium when the printing medium passes through the fusing unit 36. The printing medium, on which the image has been printed, is discharged to the discharge tray 42, by the discharge roller 41.

While printing an image on the printing medium, which is fed along the feeding path P that extends from the printing medium loading cassette 21 to the discharge tray 42, the printing medium may get twisted/misaligned. If the misaligned printing medium passes between the photosensitive body 31 and the transfer roller 35, the visible image cannot be properly transferred onto the printing medium, thereby resulting in poor printing quality. To prevent this problem, the printing medium alignment device 50, which is mounted upstream from the printing unit 13, aligns the front end of the printing medium, when the printing medium is fed toward the printing unit 13, and then transfers the printing medium to the printing unit 13.

Figure 2:
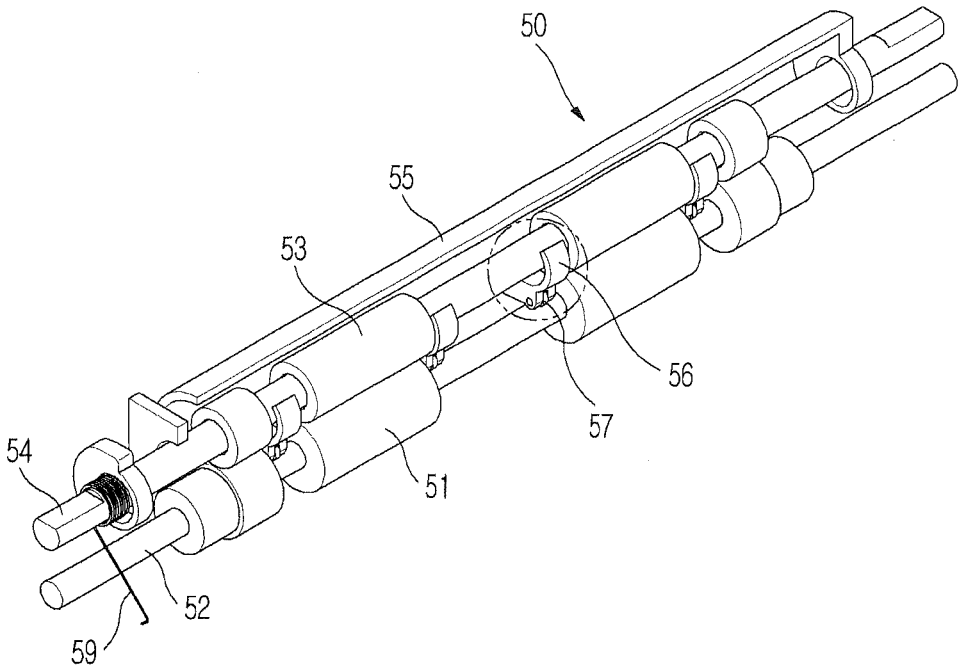
FIG. 2 is a perspective view schematically illustrating a printing medium alignment device of the image forming apparatus, in accordance with aspects of the present invention.

As shown in FIG. 2, the printing medium alignment device 50 includes: a register roller 51 that is rotated by a driving source (not shown); an idle roller 53 that contacts the register roller 51, and forms a nip N (see FIG. 4) with the register roller 51; and a register shutter 55 that blocks the front end of the printing medium, as the printing medium is fed toward the nip N, to align the printing medium. If the printing medium is properly aligned, the register shutter 55 exits the feeding path P, to allow the printing medium to enter the nip N.

The register roller 51 is coupled to a rotating shaft 52 that is mounted inside the main body 11. The shaft 52 is driven by the driving source (not shown). The idle roller 53 is rotatably coupled to a supporting shaft 54 that is fixed to the main body 11, in parallel with the rotating shaft 52. The idle roller 53 rotates on the supporting shaft 54. The idle roller 53 has an inner diameter slightly larger than an outer diameter of the supporting shaft 54. The register roller 51 and the idle roller 53 contact each other, to form the nip N therebetween. When the register roller 51 rotates, the idle roller 53 is thereby rotated in a direction opposite to the rotational direction of the register roller 51.

The register shutter 55 is loosely coupled to the supporting shaft 54, so as to rotate thereon at a predetermined angle. An elastic supporting member 59 is provided at one end of the register shutter 55. One end of the elastic supporting member 59 is coupled to the register shutter 55 and the other end of the elastic supporting member 59 is fixed to the main body 11, as shown in FIG. 1. As shown in FIG. 2, the elastic supporting member 59 positions the register shutter 55 in a first position, to block the printing medium from proceeding to the nip N, so long as an external force is not applied to the register shutter 55.

Figure 3:
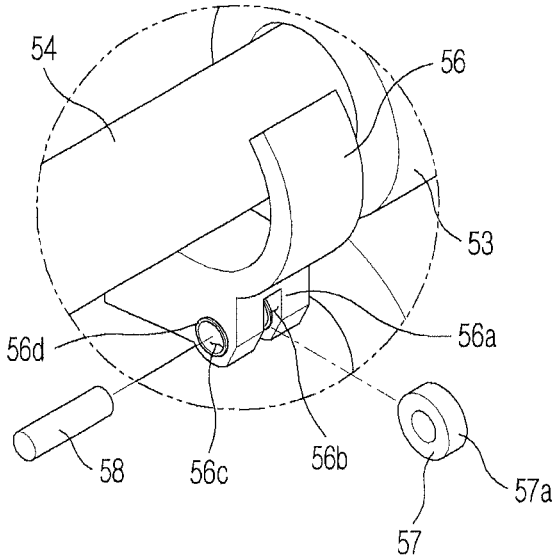
FIG. 3 is an enlarged view illustrating a part of the printing medium alignment device depicted in FIG. 2.

The register shutter 55 includes front-end touch parts 56. The front-end touch parts 56 are positioned between the rotating shaft 52 and the supporting shaft 54, to block the printing medium. As shown in FIG. 3, each of the front-end touch parts 56 has a front-end touch surface 56*a* that is flat, to contact the front end of the printing medium. When the register shutter 55 is in the first position, the front-end touch surfaces 56*a* are substantially perpendicular to the feeding direction of the printing medium. Thus, when properly aligned, the front end of the fed printing medium comes into contact with all of the front-end touch surfaces 56*a* simultaneously.

When the printing medium is fed toward the nip N, the register shutter 55 temporarily blocks the front end of the printing medium, and aligns the printing medium. If the printing medium is properly aligned, the register shutter 55 is rotated by the printing medium, into a second position that positions the register shutter 55 out of the feeding path P. In detail, if the printing medium is misaligned when fed toward the register roller 51 and the idle roller 53, the printing medium only contacts some of the front-end touch parts 56. Thus, the pushing force of the printing medium on the register shutter 55 is not sufficient to move the register shutter 55, and the printing medium is blocked from entering the nip N. Thereafter, if the printing medium becomes properly aligned, the printing medium comes into contact with all of the front-end touch parts 56, and the printing medium can then rotate the register shutter 55 out of the feeding path P (into the second position).

Each of the front-end touch parts 56 is provided with a shutter roller 57. One shutter roller 57 and touch part 56 are described here, for convenience. The shutter roller 57 is mounted on a lower portion of the front-end touch surface 56*a*, such that an outer peripheral surface 57*a* of the shutter roller 57 protrudes from the front-end touch surface 56*a*. The shutter roller 57 is coupled to a coupling shaft 58, which is rotatably mounted to the front-end touch part 56.

As shown in FIG. 3, the lower portion of the front-end touch surface 56*a* has a mounting recess 56*b* in which the shutter roller 57 is received, and a coupling hole 56*c* into which the coupling shaft 58 is rotatably inserted. A bushing 56*d* is mounted in the coupling hole 56*c*, to decrease friction between the coupling hole 56*c* and the coupling shaft 58, so that the coupling shaft 58 can rotate smoothly. If the register shutter 55 and the shutter roller 57 are made of a plastic material, and the coupling shaft 58 is made of a metal material, the coupling shaft 58 can rotate smoothly in the coupling hole 56*c*, without the bushing 56*d*.

When the printing medium comes into contact with the front-end touch surface 56*a* and rotates the register shutter 55, the shutter roller 57 is rotated by the printing medium, as the printing medium is transferred. The rotation of the roller 57 considerably decreases friction between the printing medium and the register shutter 55. Accordingly, noise due to friction between the printing medium and the register shutter 55, when the printing medium passes between the register roller 51 and the idle roller 53, is remarkably decreased, and wear to the register shutter 55 is also remarkably decreased.

Figure 4:
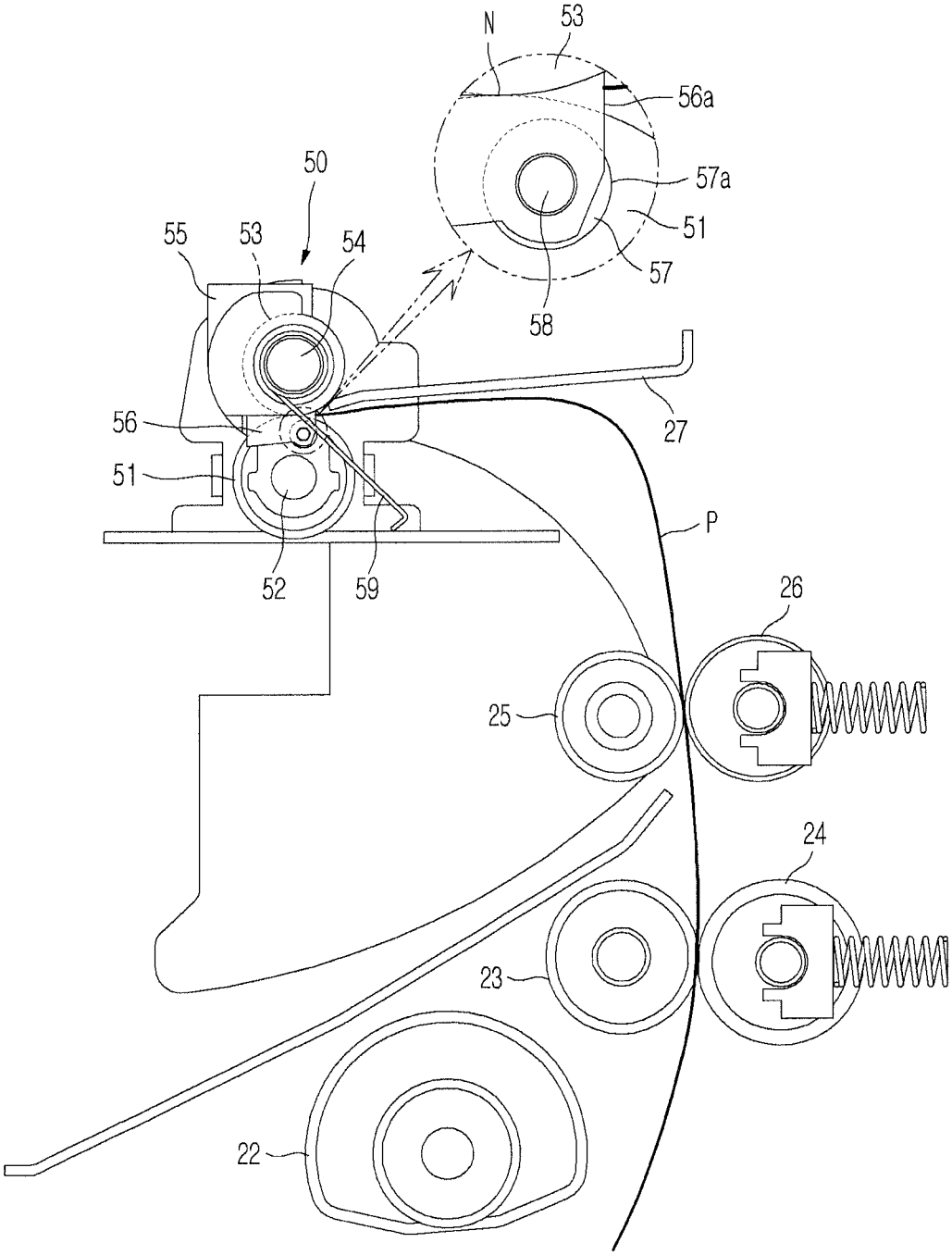
FIGS. 4 and 5 are side views for explaining an operation of the printing medium alignment device, in accordance with aspects of the present invention.

Hereinafter, an operation of a printing medium alignment device 50 of an image forming apparatus, according to aspects of the present invention, will be described with reference to FIGS. 4 and 5. As shown in FIG. 4, the printing medium is picked up from the printing medium loading cassette 21 by the pickup roller 22, and is fed down the feeding path P by the first feeding roller 23 and the second feeding roller 25. After passing the second feeding roller 25, the printing medium is guided toward the nip N, by a guide plate 27 mounted on the feeding path P upstream from the printing medium alignment device 50.

The front end of the printing medium comes into contact with the front-end touch surfaces 56*a* of the register shutter 55. If the printing medium is improperly aligned, the front end of the printing medium contacts only some of the front-end touch surfaces 56*a* of the register shutter 55. In this case, the printing medium cannot apply sufficient force to rotate the register shutter 55, because the applied force is smaller than the elastic force of the elastic supporting member 59. Therefore, the register shutter 55 does not move, and blocks the front end of the printing medium. If the printing medium is aligned with the register shutter 55, by the second feeding roller 25, the front end of the printing medium comes into contact with all of the front-end touch surfaces 56*a*.

Figure 5:
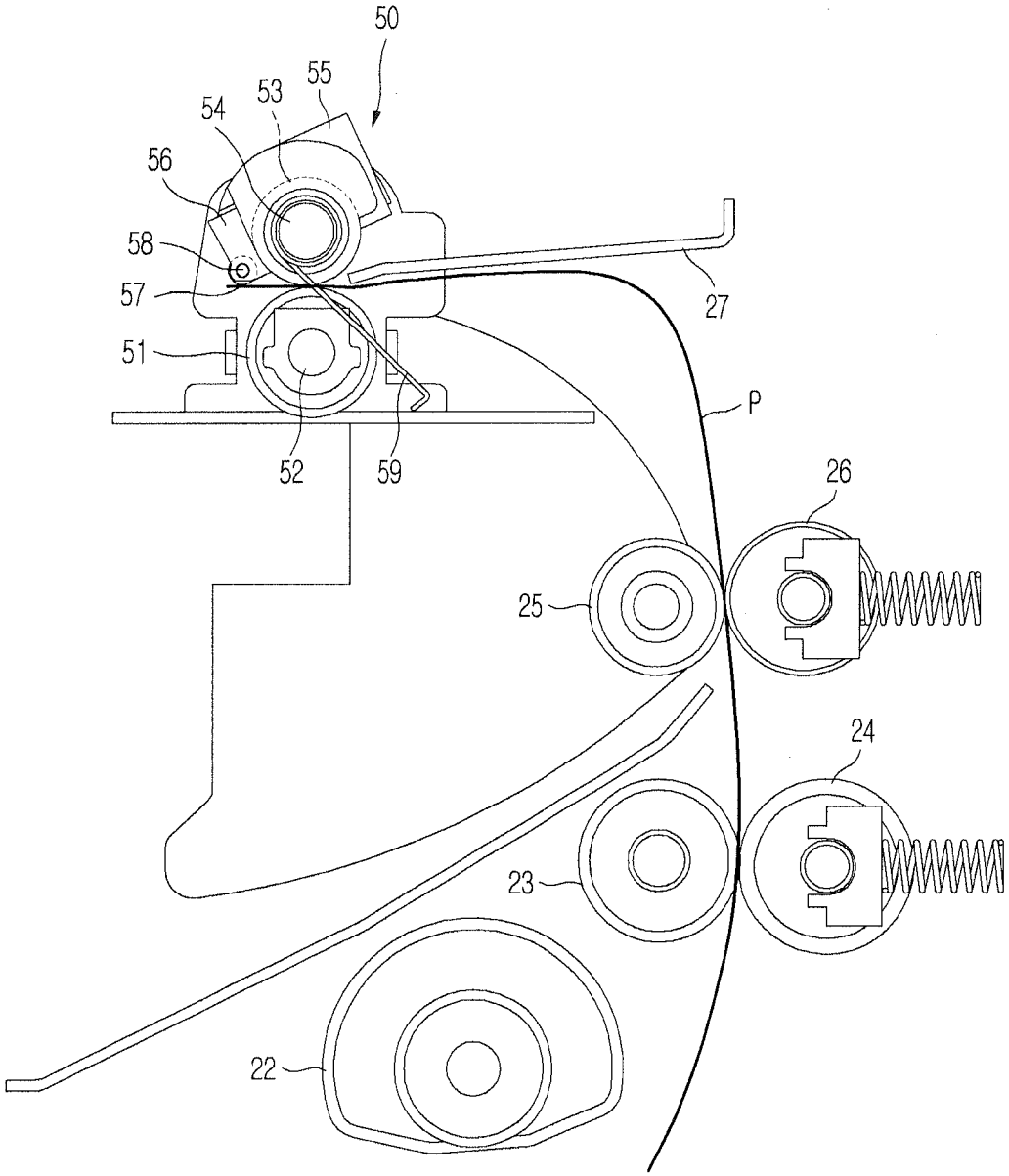

As shown in FIG. 5, if the front end of the printing medium contacts all of the front-end touch surfaces 56*a*, the pushing force of the printing medium on the register shutter 55 is sufficient to overcome the elastic force of the elastic supporting member 59. The printing medium then rotates the register shutter 55 in the clockwise direction, and the front-end touch parts 56 exit the feeding path P. The printing medium slides past the front-end touch parts 56, to pass between the register roller 51 and the idle roller 53, and proceeds toward the printing unit 13. While the printing medium slides past the front-end touch parts 56, the printing medium contacts the outer peripheral surface 57*a* of the shutter rollers 57 protruding from each of the front-end touch parts 56. The shutter rollers 57 rotate when in contact with the printing medium, thereby considerably decreasing the friction between the printing medium and the register shutter 55. Accordingly, noise, due to friction between the printing medium and the register shutter 55, is remarkably decreased, and wear to the register shutter 55 is also minimized.

In the above description, the image forming apparatus has been exemplified as an electrophotographic image forming apparatus. However, the present invention can also be applied to an ink-jet image forming apparatus, or other various image forming apparatuses, such as a photocopier, a multi-function printer, etc.

As is apparent from the above description, an image forming apparatus, according to aspects of the present invention, can remarkably decrease noise due to friction between the register shutter and the printing medium, and can reduce wear to the register shutter. The shutter rollers mounted on the register shutter considerably decrease friction between the printing medium and the register shutter, by rolling when in contact with the printing medium. Resistance to the feeding of the printing medium, due to friction with the register shutter, is reduced, and the printing medium can be fed smoothly toward the printing unit.

Although exemplary embodiments of the present invention have been shown and described, it would be appreciated by those skilled in the art that changes may be made in these embodiments, without departing from the principles and spirit of the invention, the scope of which is defined in the claims and their equivalents.

What is claimed is:

1. An image forming apparatus comprising:

a printing medium supply unit to supply a printing medium to a feeding path;

a printing unit to print an image on the printing medium; and a printing medium alignment device comprising, a register roller, an idle roller to form a nip with the register roller, to feed the printing medium along the feeding path to the printing unit, a register shutter disposed at a first position to block the printing medium from entering the nip and align the printing medium by forming a contact between the printing medium and a plurality of front-end touch parts of the register shutter, and configured to be moved by the printing medium to a second position to allow the printing medium to enter the nip; and a shutter roller mounted on at least one front-end touch part of the plurality of front-end touch parts, configured to be rotated by the printing medium so as to decrease friction between the printing medium and the register shutter when the register shutter is in the second position, the shutter roller extended beyond the front-end touch part and bottom of the register shutter.

2. The image forming apparatus according to claim 1, wherein:

the register shutter comprises a plurality of the front-end touch parts and a plurality of the shutter rollers; and the shutter rollers are mounted on each of the front-end touch parts.

3. The image forming apparatus according to claim 1, wherein the front-end touch part comprises a coupling shaft to rotatably support the shutter roller.

4. A printing medium alignment device comprising:

a register roller;

an idle roller to form a nip with the register roller;

a register shutter disposed at a first position to block the printing medium from entering the nip and align the printing medium by forming a contact between the printing medium and a plurality of front-end touch parts of the register shutter, and configured to be moved by the printing medium to a second position to allow the printing medium to enter the nip; and a shutter roller mounted on at least one front-end touch part of the plurality of front-end touch parts, configured to be rotated by the printing medium so as to decrease friction between the printing medium and the register shutter when the register shutter is in the second position, the shutter roller extended beyond the front-end touch part and bottom of the register shutter.

5. The printing medium alignment device according to claim 4, wherein:

the register shutter comprises a plurality of the front-end touch parts and a plurality of the shutter rollers; and the shutter rollers mounted on each of the front-end touch parts.

6. The printing medium alignment device according to claim 4, wherein the front-end touch part comprises a coupling shaft to rotatably support the shutter roller.

7. A printing medium alignment device comprising:

idle rollers disposed across a feeding path of a printing medium;

register rollers to contact with the idle rollers at nips, to drive the idle rollers;

a register shutter disposed at a first position to block the printing medium from entering the nips by forming a contact between the printing medium and a front-end touch part among a plurality of front-end touch parts of the register shutter, and configured to be moved by the printing medium to move to a second position to allow the printing medium to pass through the nips;

a shutter roller mounted on each of the front-end touch parts, to decrease friction between the printing medium and the register shutter, by rotating while in contact with the printing medium when the printing medium passes through the nips, the shutter roller extended beyond the front-end touch part and bottom of the register shutter.

8. The printing medium alignment device of claim 7, wherein the shutter rollers are mounted on the front-end touch parts, such that the shutter rollers do not contact the printing medium when the register shutter is in the first position.

9. The printing medium alignment device of claim 7, further comprising an elastic supporting member, provided at one end of the register shutter, to bias the register shutter toward the first position.

10. The printing medium alignment device of claim 7, wherein the register shutter is moved from the first position to the second position, if the printing medium is driven against all of the front-end touch parts simultaneously.

11. The printing medium alignment device of claim 7, further comprising a supporting shaft to rotatably support the idle rollers and the register shutter.

* * * * *